US006158913A

United States Patent [19]

Dumler et al.

[11] Patent Number: 6,158,913

[45] Date of Patent: Dec. 12, 2000

[54] MASCARA UNIT

[75] Inventors: Norbert Dumler, Ansbach; Werner Fischer, Burk; Dieter Wolfsgruber, Vestenberg, all of Germany

[73] Assignee: georg karl geka-brush GmbH, Waizendorf, Germany

[21] Appl. No.: 09/350,161

[22] Filed: Jul. 9, 1999

[30] Foreign Application Priority Data

Jul. 18, 1998 [DE] Germany ..... 198 32 403

[51] Int. Cl.[7] ..... A46B 11/00

[52] U.S. Cl. ..... 401/191; 401/122; 401/126; 401/107

[58] Field of Search ..... 401/191, 99, 107, 401/108, 115, 268, 127, 129, 126, 122

[56] References Cited

U.S. PATENT DOCUMENTS 2,850,753 9/1958 Pelletier ..... 401/191
5,332,325 7/1994 Crosnier et al. ..... 401/191
5,382,107 1/1995 Nian ..... 401/191

FOREIGN PATENT DOCUMENTS 17 05 452 8/1955 Germany .
38 08 576 2/1989 Germany .

*Primary Examiner*—David J. Walczak
*Attorney, Agent, or Firm*—Browdy and Neimark

[57] ABSTRACT

In a mascara unit comprising an applicator fixed to a holder and a reservoir for mascara, the applicator dipping into the reservoir in the condition of non-use and transport and being movable out of the reservoir for the application of mascara, it is provided that the applicator and the reservoir are designed as a unit so that the applicator can be moved out of and into the reservoir through actuation by one hand.

4 Claims, 1 Drawing Sheet

1
2
3
4
5
6
7
8
9
10
11
12
13
14
15
16
17
18
19

MASCARA UNIT

BACKGROUND OF THE INVENTION

1. Field of the Invention

The invention relates to a mascara unit comprising an applicator fixed to a holder and a reservoir for mascara, the applicator dipping into the reservoir in the condition of non-use and transport and being movable out of the reservoir for the application of mascara.

2. Background Art

Mascara units of the generic type are conventionally designed such that the reservoir has a closure cap, an external thread being provided in the vicinity of the outlet of the reservoir, on which can be screwed the internal thread of the closure cap. The handle of an applicator, as a rule in the form of a mascara brush, is mounted on the inner bottom of the closure cap, the applicator dipping into the reservoir when the cap is placed on and the cap then being screwed on for leakproof closure. In the reverse case the cap is screwed off for application and the applicator, which is disposed on the handle, is pulled out of the reservoir by the cap being removed, a stripper being provided in the vicinity of the opening for excess mascara to be stripped off.

With this known design, a user will need one hand to hold the mascara container and the other hand to operate the closure cap, i.e. to unscrew and remove it. Also during the application of the mascara on the lashes, one hand of the user is needed to hold the container separately.

SUMMARY OF THE INVENTION

It is an object of the invention to embody a mascara unit of the type mentioned at the outset so that simplified handling is rendered possible.

According to the invention, this object is attained by the applicator and the reservoir being designed as a unit so that the applicator can be moved out of and into the reservoir through actuation by one hand such that the applicator is mounted to be able to swing out for application.

This means the realization of an entirely novel concept, genuine singlehand operation being ensured, while the second hand remains free during the application because there is no longer any need for it to hold the reservoir.

In keeping with another embodiment of the invention, it can be provided that the applicator is disposed in a cap-type sliding sleeve which has a lateral slit so that the pushed out applicator is able to swing out. For being put into use, the applicator is pushed through the opening out of the reservoir in a first phase of motion and can then be swung out through the slit preferably by 180°.

Various mechanisms are conceivable to realize the pivoting motion. Preferably, the holder of the applicator may comprise a section provided with teeth, with which mesh the teeth of an externally displaceable elastic band.

By alternative it can be provided that the holder comprises an actuating section which can be actuated through an opening of the sliding sleeve for a swing-out motion about a pivot bearing to be effected. In this case, the swing-out motion can be realized by the thumb of a hand in a manner similar to the actuation of a lighter.

So as to avoid problems posed by the complete wetting of the applicator in the case of more viscous materials or when the reservoir is only partially filled, it can be provided that a mixing ring is disposed in the reservoir or that the applicator has a telescoping handle.

Instead of a purely linear motion for pulling the applicator out of the reservoir, this can also be implemented by a screwing motion.

The sliding sleeve can be of snap-in design and/or forked and a stop can be allocated to its lengthwise motion.

For soiling to be avoided, an additional cap or cover can be applied over the area of the slit.

Details of the invention will become apparent from the ensuing description of a preferred embodiment, taken in conjunction with the drawing.

DESCRIPTION OF THE PREFERRED EMBODIMENT

Figures 1, 2, 3, 4:
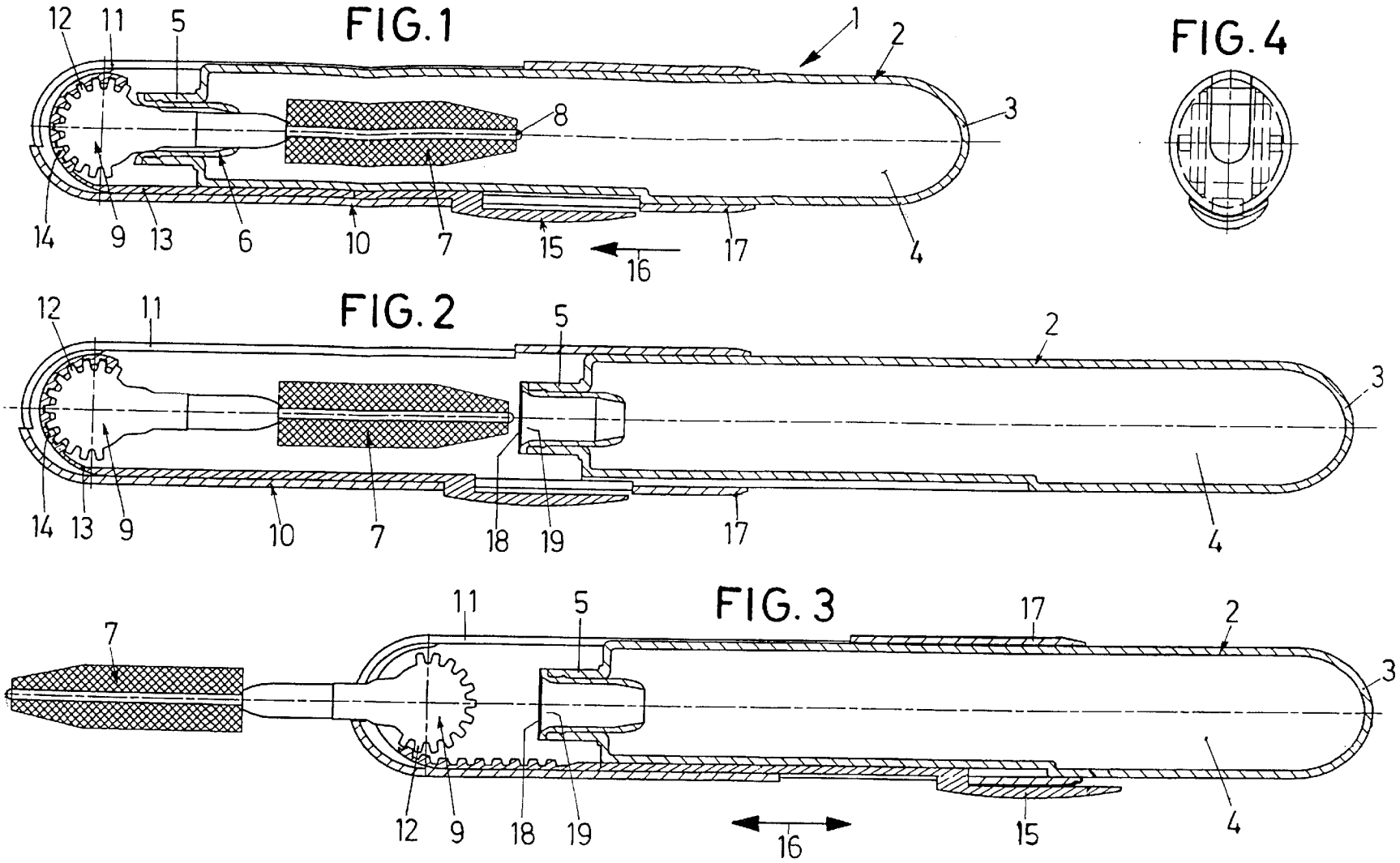
FIG. 1 is a longitudinal section through a mascara unit according to the invention in a condition of non-use.
FIG. 2 is an illustration corresponding to FIG. 1 of the mascara unit in an extended condition.
FIG. 3 is an illustration corresponding to FIGS. 1 and 2 with the applicator swung out.
FIG. 4 is a sectional view.

A mascara unit 1 seen in the drawing comprises a reservoir 2 with a rounded bottom 3 and an interior space 4 for the take-up of mascara, at the end of which opposite the bottom 3 a neck 5 is formed, which is tapered in cross-section and in which a stripper 6 is inserted.

An applicator dips into the interior space 4, which is a mascara brush 7 in the exemplary embodiment, conventionally formed by bristles held between intertwisted wire sections, the proximal end of the wire core 8 formed by the intertwisted wire sections being fixed in a holder 9.

A cap-type sliding sleeve 10 is placed on the reservoir 2; it has a slit 11 on one side, the width of which corresponds approximately to the width of the mascara brush 7.

The holder 9 comprises a portion in the form of a segment of a circle with external teeth 12. This portion in the form of a segment of a circle is enveloped by an elastic band 13, which is provided with teeth 14 in the vicinity of this portion, the teeth 14 meshing with the teeth 12 of the holder 9.

The elastic band 13 extends along a side of the reservoir 2 and has an actuating section 15 on its free end, which—as roughly outlined by the arrow 16—enables the band 13 to be shifted back and forth so that, by its teeth 14 meshing with the teeth 12 of the holder 9, the mascara brush 7—as seen in FIG. 3—can be swung out by 180° through the slit 11 and is then ready for application.

For such a swing-out motion to be possible, the sliding sleeve 10 is movable via an actuating sleeve 17 by the thumb of a hand in the direction of the arrow 16, starting from the condition of non-use and transport seen in FIG. 1. Upon this shifting motion, the brush soaked with mascara passes the stripper 6, a slit elastic membrane 18 closing the aperture 19 of the reservoir 2 when the brush 7 is pulled out. Starting from this position, the mascara brush 7 can then be swung out via the actuating section 15—as described above—by the same hand and the same thumb that has before implemented the axial sliding motion. In the same way the brush can be moved back into the reservoir 2 for the unit to be kept when out of use and transported.

What is claimed is:

1. A mascara unit comprising:

an applicator (7) fixed to a holder (9), and a reservoir (2) for mascara;

the applicator (7) and the reservoir (2) forming a unit;

a stripper (6) engaged in an opening (5) of the reservoir;

the applicator (7) extending into the reservoir (2) when not in use and while being transported; and cap means (10) moveably engaged to the holder for sliding the applicator through the stripper (6) and thereafter rotating the applicator 180° to an axis of the reservoir (2) to project away from the reservoir to permit application of mascara.

2. The mascara unit of claim 1, wherein said cap means has a sliding sleeve (10) having a lateral slit permitting the applicator to rotate the 180° there through after being slid through the stripper and an elastic band moveably engaged to the holder.

3. The mascara unit of claim 2, wherein the holder has teeth which mesh with teeth of the elastic band;

said band being separably displaceable lengthwise from the sliding sleeve to rotate the holder.

4. The mascara unit of claim 3, wherein said elastic band has an actuating section (15) which can be actuated through an opening in the sliding sleeve (10) to displace the elastic band.

* * * * *